United States Patent [19]

Negrao

[11] 4,239,091

[45] Dec. 16, 1980

[54] MUFFLER

[76] Inventor: Paulo M. Negrão, Largo do Arouche, no 252-apartment 501, São Paulo, Brazil

[21] Appl. No.: 933,889

[22] Filed: Aug. 15, 1978

[30] Foreign Application Priority Data

Sep. 16, 1977 [BR] Brazil ..... 5701149[U]

[51] Int. Cl.[2] ..... F01N 1/24; F01N 7/16; F01N 7/18

[52] U.S. Cl. ..... 181/243; 181/244; 181/246; 181/248; 181/252

[58] Field of Search ..... 181/243, 246, 247, 248, 181/252, 282, 294, 260, 281, 244

[56] References Cited

U.S. PATENT DOCUMENTS

| | | | |
|---|---|---|---|
| 1,622,692 | 3/1927 | Wendling | 181/281 |
| 2,244,393 | 6/1941 | Haas | 181/243 |
| 3,220,506 | 11/1965 | Vernet | 181/260 |
| 3,227,242 | 1/1966 | Mattoon | 181/282 |
| 3,522,863 | 8/1970 | Ignoffo | 181/252 |

*Primary Examiner*—L. T. Hix
*Assistant Examiner*—Benjamin R. Fuller
*Attorney, Agent, or Firm*—Allegretti, Witcoff & McAndrews

[57] ABSTRACT

A muffler having a tubular cylindrical fiber-reinforced resin body with tapered extremities ending in short necks, through said body being disposed an axial aluminum tube with extremities projecting outwardly from the assembly, said tube being perforated in the section inside the body and the internal space between the body and tube being filled with sound-absorbing material. During assembly of the muffler, the internal tube and the external body are fastened by means of clamps, with the interposition of gaskets adhered with the body resin itself in order to avoid leakage between the tube and body. The sound absorbing material is also mounted on pre-fabricated channels in the body, thus eliminating the need of handling it.

1 Claim, 3 Drawing Figures

MUFFLER

BACKGROUND OF THE INVENTION

As it is known by everybody, after the combustion of fuel, the internal combustion engines produce a certain quantity of gases in the combustion chambers, which gases must be exhausted as a condition required for the continued operation, with the new beginning of the (thermodynamic and mechanical) cycle.

The elimination of these gases has always constituted a major problem for engineering, because, not only they are a harm to health and a cause of less comfort, but also the combustion products influence directly the motor output and reduce the useful life of the equipment or the vehicle. Some of their harming characteristics are given below:

poisonous;

corrosive;

conductive of heat generated in the combustion chambers;

conductive of noise produced by the motor;

inhibitive of combustion in the next cycle;

pollution of the atmosphere.

The solutions proposed are in a great number since the invention of the explosion motor more than a century ago, in order to reduce the undesirable effects of the combustion gases. Basically, the exhaust assembly consists of one or more collectors, discharge pipes and mufflers. The exhaust collector is attached to the combustion chambers and connects, through pipings, the cylinder exhaust windows joining them in a single flanged pipe. The discharge pipe serves to collect the gases at the collector outlet and conduct them to the muffler. Normally, this pipe has many curves to bypass hindrances such as depressions in floors, shafts, and the like.

For receiving the gases from the discharge pipe and expelling them to the atmosphere, the muffler is, usually, a cylindrical box, of a circular, elliptical or oval section, the function of which is to reduce sound vibrations produced by the motor.

THE PRIOR ART

In fact, two basic types of mufflers, according to their construction and design, are known in this branch of the market:

conventional;

sporting type.

The conventional or original mufflers are those designed by manufacturers or assemblers of vehicles and/or equipment, taking strictly into consideration the official standards and the legislation in force, as well as conditions not harmful to motors and vehicles.

They are totally made of tubes and stamped steel plates, to adequate shapes and sizes, so that the gas flow is carried through a labyrinth-like path. Gases, when passing past the muffler, undergo compressions and expansions and change their directions, so that sound vibrations are efficiently reduced.

Such mufflers provide have the following advantages: they are of a low cost and have a good sound absorption, but their useful life is rather short and their load loss is high.

As one of vehicle assemblers' purposes is to reduce to the minimum extent possible industrial costs, mufflers have to be made taking also in account this factor, but not to such an extent as to impair the thermal output of the system.

On the other hand, the comfort provided to users is one of the sales attractions. Silence means comfort. Therefore, mufflers must develop a good sound absorption. This characteristic is obtained, in general, by increasing load losses.

Since the raw material used in the making of conventional mufflers must be cheap, have a good mechanical strength and provide lower industrial costs, low carbon-content steel has been adopted all over the world. This material, however, is easily rust-attacked when in contact with air, water and combustion gases. Also, as the muffler has a small wall thickness, its useful life becomes considerably impaired.

Load loss, in turn, represents the pressure to be maintained at the motor cylinder outlets so that all this mass of combustion gases can be expelled to the atmosphere. Load loss increases as the number of motor rotations increases and as the mass of gases increases in each cycle, causing, accordingly, the flow velocity to rise. With the increase of the pressure at the cylinder outlets, a greater quantity of residual gases will remain in the combustion chambers, causing difficulties to the combustion and requiring a greater mechanical effort to eliminate such gases. The usual pressure/volume diagram shows the thermal output reduction as the cycle pressure range gets narrower.

As for the sporting type mufflers, as it is suggested by their name, these are the mufflers made for those who desire the maximum performance from their engines and cars, although this may cause a decrease in terms of comfort by permitting a higher noise level in the engine.

This type of muffler usually does not meet the necessary technical requirements according to dynamic tests (vehicles in movement) imposed by the Brazilian Association of Technical Standards (ABNT). Nevertheless, as the transit inspecting authorities cannot reckon at the present moment on adequate instrumentation and locations for the execution of such tests, many vehicles under irregular conditions are in circulation, contributing to an increase in the noise level or sound pollution.

These mufflers are constructed with tubes and steel plates, in addition to other materials having good acoustic properties, such as glass wool and rock wool. The exhaust gas flow passes through a perforated tube covered by a sound-insulating material. It is through this tube that the direct contact of gases with the sound-absorbing material takes place. In this passage, sound vibrations are reduced.

Due to the competition existing in the related market, there are product cost restrictions causing most manufacturers to prefer another result, namely inexpensive units which afford excellent sound-absorbing properties. That is, the load losses generated sometimes become even greater than those measured at conventional mufflers.

Generally then, the advantages obtained with such a "sporting" assembly are:

low load loss; and simple construction; but, they also have disadvantages, such as:

insufficient sound absorption;

glass- or rock-wool handling;

short lifetime; and doubtful efficiency.

The main advantage of that type of muffler is the possibility of construction affording the minimum resistance to the gas flow, thereby avoiding the already mentioned load losses. Also it is constituted of a reduced number of components, thus simplifying considerably the assembly operation.

The disadvantages include insufficient sound absorption, allowing a sound level rise above the standards acceptable by the regulating authorities. They are also inconvenienced in the utilization of glass or rock wool having microfilaments which penetrate into the skin and the respiratory organs of those who handle it, if the necessary cautions are not followed. Thus the handling of this wool causes a considerable delay in the manufacturing process.

Also as the muffler raw material is carbon steel, it tends to become oxidized and undergo the corrosion process very quickly. As a consequence, its lifetime is limited.

If the user is not an expert on such matters, he may use a muffler which will impair the motor functioning and, consequently, cause a waste of fuel. This is a common practice in sporting mufflers having a "strangled" passage.

SUMMARY OF THE INVENTION

The muffler of this invention, due to the elements constituting it, has an appearance like that of a common sporting muffler described above. Important innovations, however, have been introduced so that the functional characteristics have become completely altered and the durability enhanced.

In developing the proposed assembly, the raw materials have been chosen from a new point of view, that is, from their physical-chemical properties, according to the characteristics of each component and the conditions under which they operate.

As a function of the substitution of the raw materials by other ones, it has been possible to eliminate the usual dampers and simplify the assembling operation.

The advantages gained include:

low load loss;
simple construction;
good sound absorption;
good durability;
good appearance; and
low weight.

BRIEF DESCRIPTION OF THE DRAWINGS

The attached drawings illustrate the present invention, in which.

Figure 1:
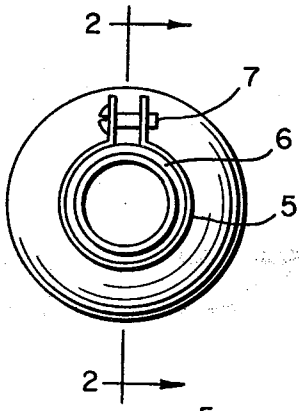
FIG. 1 shows an end view of the muffler in question.
Figure 2:
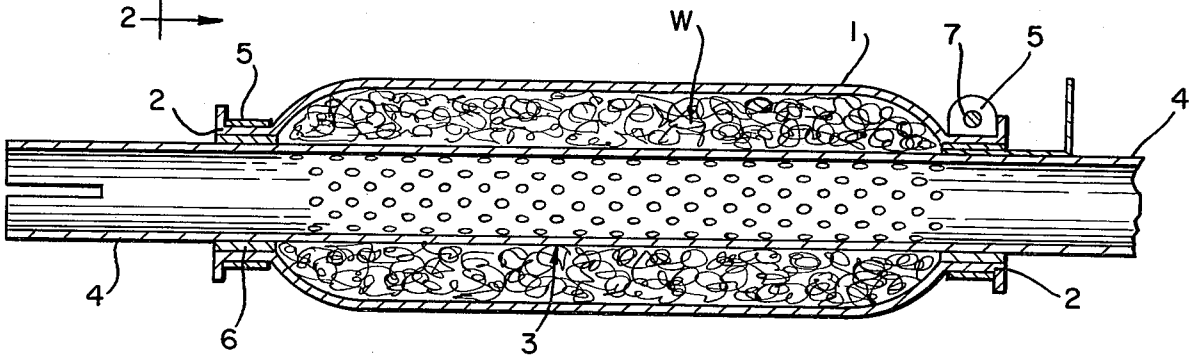
FIG. 2 shows a longitudinal section of the assembly along line 2—2 of FIG. 1.
Figure 3:
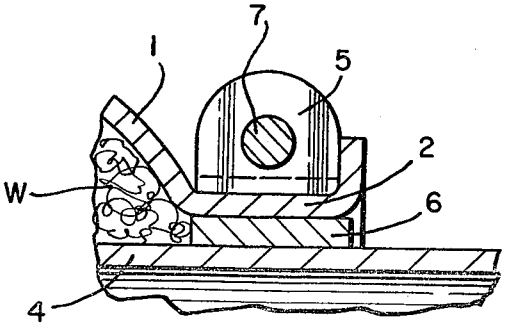
FIG. 3 is a scrap view, partly in section, of a clamp unit on the same muffler.

As shown in the above mentioned figures, the present muffler designed to eliminate noises caused by gases from vehicle motors in general, is the type having a tubular cylindrical body 1 with tapered extremities ending in short necks 2 having radially outwardly bent ends 2*a* (FIG. 3). Through said body is disposed an axial aluminum tube 3 with extremities 4 projecting outward from the assembly beyond ends 2*a*, said tube being perforated in the section inside body 1 and the internal space between said body 1 and tube 3 being filled with glass wool W.

As an improvement, the external body 1 is made by casting polyester resin reinforced with fiberglass and/or rock wool into the shape of the body. Furthermore, annular gaskets 6 are formed around necks 2 and which are adhered to the body 1 resin to avoid leakage.

In assembling the parts, the internal tube 3 and the external body 1 are fastened by means of C-clamps 5 engaged about gaskets 6 and tightened by screws 7.

The sound absorption material is positioned inside body 1, avoiding the handling of fiberglass or rock wook W during installation.

One of the great advantages of the present muffler is its low load losses as compared with those of other types known. Also its construction has been considerably simplified due to the substitution of reinforced resin materials.

Further since the muffler has increased efficiency of sound absorption, the usual dampers, baffles, sieves or screens have been eliminated and the usual welds have been substituted for by clamp-type fastening means.

The body 1 is pre-cast with polyesther resin reinforced by fiberglass or rock wool. During assembly, the parts are fastened by means of clamps and glued with the resin itself, assuring protection against leakage. Also the usual chrome-plated tube surface has been substituted for by the polished extremity of the tube 4, which is of aluminum.

As they are pre-cast, the body parts are given the final finish at the outset, thus eliminating further treatments, such as painting, labeling (rotulagens), etc.

Having an excellent stability in contract with corrosive gases and the air (oxidizing environment), the present muffler has a longer life than other types known, aluminum possessing the advantage of having a self-inhibiting oxidation; and polyesther and fiberglass being practically rust-proof;

As the outside of the muffler is made of polished aluminum with a reinforced resin body which is pre-cast with engraving and colored, the muffler is visually attractive in the marketplace.

Aluminum and reinforced resin also have specific gravities lower than that of steel. Therefore the muffler is lighter, and presents fewer problems when subjected to vibrations under use conditions.

Because the raw materials used in the present muffler are more expensive, the product final cost is estimated to be higher than that of the usual mufflers available. However, taking into consideration the greater durability foreseen, there is an economic advantage in favor of the proposed unit;

Its potential lower resistance to impacts is not significant, as, at present, resin reinforced with fiber is used extensively in the automotive industry, e.g., in car bodies. Actually during tests performed under severe conditions, the material offered a perfect resistance;

The muffler's potential lower resistance to high temperatures has been the subject of study as it could limit the use of the resin body. But, during the tests caried out by simulating conditions more severe than those taking place in actual use, it has shown material stability, there being also, as regards safety, additives improving the material properties in this aspect.

The present muffler, particularly due to its greater capacity of reducing noises caused by motors, to its load losses less than those of the existing models, to its greater durability by the fact that it has no unpleasant natural vibration frequency under use conditions, has, as a whole, characteristics of its own, presenting a new and different technical effect as regards economy and comfort.

I claim:

1. A muffler, comprising a tubular synthetic resin body reinforced with glass fiber material said body having tapered extremities ending in short necks, an axial aluminum tube extending through said body, said tube being provided with extremities projecting outwardly from the body necks, said tube also being perforated in the section located inside the body, a sound-absorbent glass fiber material filling the internal space between said body and said aluminum tube, resilient gasket material interposed between said necks and said tube, said gaskets being adhered to the resin body material, clamps engaging around said body necks and means for tightening the clamps to retain the body parts together and to avoid leakage between the resin body and the aluminum tube.

* * * * *